US012765616B2

(12) United States Patent
Chabner Thompson

(10) Patent No.: US 12,765,616 B2
(45) Date of Patent: Oct. 20, 2026

(54) TREATMENT BRASSIERE

(71) Applicant: Elizabeth Sarah Chabner Thompson, Greenwich, CT (US)

(72) Inventor: Elizabeth Sarah Chabner Thompson, Greenwich, CT (US)

( * ) Notice: Subject to any disclaimer, the term of this patent is extended or adjusted under 35 U.S.C. 154(b) by 1 day.

(21) Appl. No.: 18/632,664

(22) Filed: Apr. 11, 2024

(65) Prior Publication Data

US 2025/0000180 A1 Jan. 2, 2025

Related U.S. Application Data

(60) Provisional application No. 63/523,808, filed on Jun. 28, 2023.

(51) Int. Cl.
*A41C 3/00* (2006.01)

(52) U.S. Cl.
CPC ..... *A41C 3/0064* (2013.01)

(58) Field of Classification Search
CPC ..... A41C 3/0064
USPC ..... 450/53
See application file for complete search history.

(56) References Cited

U.S. PATENT DOCUMENTS 5,716,255 A * 2/1998 Abercrombie ..... A41C 3/12 2/463
5,980,359 A * 11/1999 Brown ..... A41C 3/08 450/23
6,055,668 A * 5/2000 Gros ..... A41D 13/1245 2/69
6,176,761 B1 * 1/2001 Underhill ..... A41C 3/0014 450/1
6,203,399 B1 * 3/2001 Hackney ..... A41C 3/00 2/46
6,264,530 B1 * 7/2001 Cosentino ..... A41C 3/12 450/60
6,341,377 B1 * 1/2002 Faries, Jr. ..... A41D 27/13 420/57
7,740,574 B2 6/2010 Pilla et al.
7,905,763 B1 * 3/2011 Frank ..... A61F 13/141 450/37
8,075,367 B2 * 12/2011 Taylor ..... A41C 3/10 2/57
9,943,120 B1 * 4/2018 Rendone ..... A41C 3/0057
9,961,946 B2 * 5/2018 Calhoun ..... A41C 3/144
10,327,480 B2 * 6/2019 Khan ..... A61F 13/47
11,317,659 B2 5/2022 Song
12,150,496 B2 * 11/2024 Zarabi ..... A41C 3/0021
2009/0081925 A1 * 3/2009 Shweky ..... A41C 3/0042 450/86
2009/0209173 A1 * 8/2009 Arledge ..... A41C 3/0057 450/86
2017/0200274 A1 * 7/2017 Tan ..... G06V 30/2504
(Continued)

*Primary Examiner* — Gloria M Hale
(74) *Attorney, Agent, or Firm* — Kaplan Breyer Schwarz, LLP

(57) ABSTRACT

A treatment brassiere for providing treatment/pain relief for various skin conditions of the inframammary fold. The brassiere includes or accepts an inframammary-fold treatment-device (IMFTD) retainer that, in use, receives an inframammary-fold treatment device. The IMFTD retainer is located very near to, overlying, or partially overlying the inframammary fold of the wearer of the brassiere, so as to position the inframammary-fold treatment device at a location suitable for delivering treatment to the affected area.

13 Claims, 7 Drawing Sheets

(56) References Cited

U.S. PATENT DOCUMENTS

| | | | | |
|---|---|---|---|---|
| 2017/0303603 | A1* | 10/2017 | Huyghe | A41C 3/144 |
| 2018/0332905 | A1* | 11/2018 | Stephens | A41C 3/0064 |
| 2019/0159527 | A1* | 5/2019 | Guarnaschelli | A41C 3/0014 |
| 2020/0077718 | A1* | 3/2020 | Thompson | A41D 13/1281 |
| 2023/0091122 | A1* | 3/2023 | Harrison | A41D 27/133<br>450/57 |
| 2023/0255274 | A1* | 8/2023 | Cotton | A44C 17/02<br>450/89 |
| 2025/0000180 | A1* | 1/2025 | Chabner | A41C 3/0064 |

* cited by examiner

TREATMENT BRASSIERE

FIELD OF THE INVENTION

The present invention relates to brassieres in general and, more particularly, to adaptations thereof for providing treatment and/or pain relief.

BACKGROUND OF THE INVENTION

The inframammary fold (IMF) is anatomically defined as the region where the skin of the lower pole of glandular breast tissue meets the chest wall. The breast naturally creases at this landmark, and in large breasts or ptotic breasts the skin on the underside of the breast often approximates the skin beneath the inframammary fold, thus folding back upon itself.

These opposing layers of skin at the IMF may result in skin-on-skin friction and an accumulation of moisture. Either of these factors can result in irritation, inflammation, and even the loss of the most superficial layer of the skin-on-skin at the fold. This can lead to a variety of complications, including bacterial or fungal infections.

Additionally, skin-on-skin configurations such as the IMF are particularly susceptible to Acute Radiation Dermatitis (ARD). In addition to discomfort due to the itching, burning, and irritation, ARD can result in secondary bacterial and yeast superinfections. Treatments for ARD typically include topical preparations, such as moisturizing with oil-in-water moisturizers, creams, ointments, topical corticosteroids, etc.

SUMMARY

The present invention provides treatment, comfort, and a goal of reduction in pain for a patient experiencing inflammation, infections, and other skin problems occurring at or very near the IMF.

The illustrative embodiment of the invention is a brassiere that is capable of accommodating devices, etc., that implement various treatment/pain-relief (hereinafter collectively "treatment") modalities for addressing the aforementioned issues.

In accordance with the present teachings, such a brassiere includes or accepts a retaining structure(s) (hereinafter "retainer") near to or overlying the IMF of the wearer of the brassiere. Consequently, the retainer is disposed in a region near the bottom of the breast cups. In this context, the retainer should position the treatment devices, etc., at the margin of or overlying the IMF; the retainer may extend 20 to 30 millimeters (mm) inferior to the lowest point of the breast cups.

The retainer has a form suitable for receiving the articles, etc., that implement treatment/pain-relief modalities. Those treatment/pain relief modalities include, without limitation, cryotherapy, pulsed electromagnetic field (PEMF) therapy, or vibro-analgesia. As such, the retainer may support a cooling pack, cooling tubes, tubes containing electrically conductive wires, etc.

In some embodiments, the retainer is a sleeve. In some other embodiments, the retainer is a plurality of loops. In some embodiments, the retainer comprises a plurality of pockets. In some embodiments, the retainer is disposed on an exterior surface of the treatment brassiere (i.e., the surface that does not contact a wearer's skin). Other configurations of the retainer, as may occur to those skilled in the art in light of the present disclosure, may suitable be used.

In some embodiments, the retainer is integral to the brassiere; that is, the retainer is a permanent feature thereof. In some other embodiments, the retainer is a discrete component that removably couples to a brassiere, such as via the use of hook-and-loop fastener.

In some embodiments, the invention provides a treatment brassiere comprising an inframammary-fold treatment-device (IMFTD) retainer.

In some embodiments, the invention provides a treatment brassiere comprising two breast cups and an inframammary-fold treatment-device (IMFTD) retainer.

In some embodiments, the invention provides a method for treating skin irritations associated with an inframammary fold, the method comprising disposing an inframammary-fold treatment device, or a part thereof, in an inframammary-fold treatment-device (IMFTD) retainer of a brassiere; and activating the inframammary-fold treatment device, unless the inframammary-fold treatment device is passively acting.

DETAILED DESCRIPTION

Figure 1:
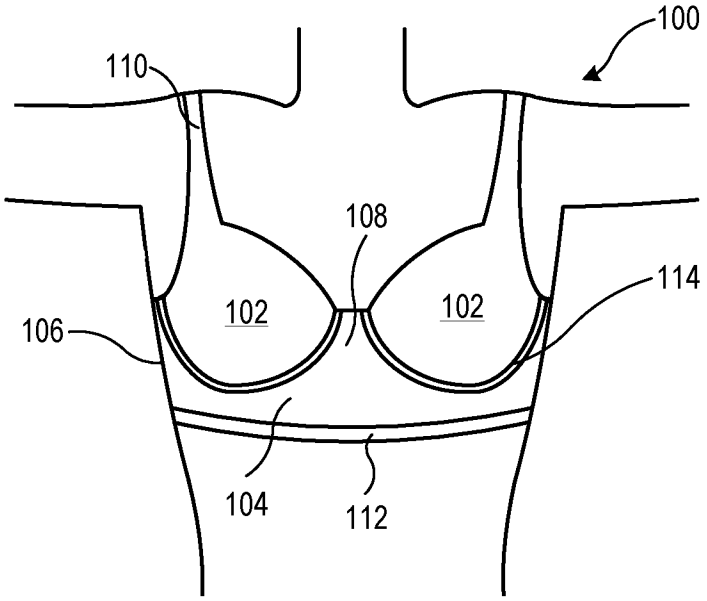
FIG. 1 Prior Art
FIG. 1 depicts a conventional brassiere.

FIG. 1 depicts salient features of conventional brassiere 100. Brassiere 100 is representative of one of many different styles of brassiere. Brassiere 100 includes cups 102, cradle 104, wings 106, center front/gore 108, straps 110, underband 112, and underwire channel 114, interrelated as shown. Additionally, bra 100 includes a back closure (not depicted). Those skilled in the art are familiar with the construction and fabrication of brassiere 100, and other styles of brassiere.

In accordance with the present teachings, a brassiere, such as brassiere 100, is modified so that it is capable of accommodating articles, devices, etc., that implement various treatment/pain-relief modalities for addressing issues arising at the inframammary fold (IMF).

Modalities for treatment and pain relief for a patient experiencing inflammation, irritation, infections, and other skin problems occurring in the region of the inframammary fold may include, among any others, one or more of the following: cryotherapy, pulsed electromagnetic field (PEMF) therapy, and vibro-analgesia.

The therapeutic benefits of cryotherapy—cold therapy—have been known for many years. Multiple mechanisms are believed to contribute to the therapeutic benefit of cryotherapy, including a slowing of the inflammatory process, reduced nerve-conduction velocity, and the induction of vasoconstriction. The use of ice/cold packs for reducing inflammation and swelling, and providing pain reduction and analgesic relief is well accepted in medicine and homeopathic strategies. More recent developments include devices that circulate a cooling fluid (typically chilled water) through tubes, and thermoelectric devices. Thermoelectric cooling (solid-state cooling) utilizes the Peltier effect to remove heat. Thermoelectric coolers for pain management are commercially available from Innovative Medical Equipment, LLC of Beachwood Ohio, and others.

PEMF therapy applies intermittent, short duration, magnetic-field pulses to living tissue. This induces electrical currents in the therapy zone. PEMF has a variety of applications, and as is relevant here, may provide pain and inflammation relief. PEMF devices are commercially available from Resona Health of Cocoa Beach, FL, and others. Applying vibratory stimulation to the skin may reduce pain. This effect is known as vibratory analgesia. Vibratory pain relief devices are commercially available from Pain Care Labs of Atlanta, GA, and others.

As used in this disclosure and in the appended claims, the term "inframammary-fold treatment device" refers to any of the devices or parts thereof (e.g., tubing, etc.) that are used to treat inflammation, irritation, infections, and other skin problems occurring in the region of the inframammary fold.

Figure 2:
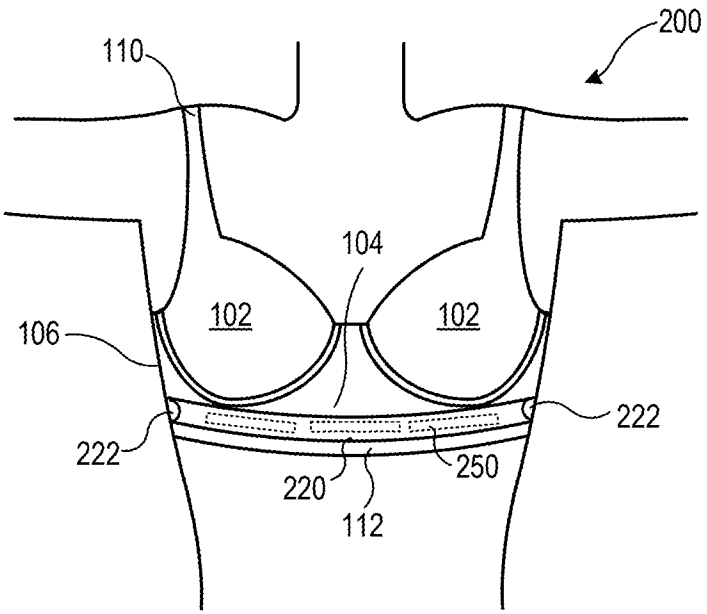
FIG. 2 depicts a brassiere that is physically adapted to provide treatment/pain relief to a wearer at a location that borders, overlies, or partially overlies the IMF in accordance with a first illustrative embodiment of the present invention.

FIG. 2 depicts brassiere 200 in accordance with an illustrative embodiment. Brassiere 200 has the same overall structure as conventional brassiere 100, except for the addition of inframammary-fold treatment-device ("IMFTD") retainer 220. As used in this disclosure and in the appended claims, the term "inframammary-fold treatment-device retainer" means a retaining element(s) that is dimensioned and arranged to receive an inframammary-fold treatment device, and suitably positioned so that the treatment provided by the inframammary-fold treatment device can be reasonably expected to be delivered to the inframammary fold (or within 30 mm thereof) of a patient wearing the brassiere to treat skin problems, as referenced above, that may arise at or very near to the IMF.

Retainer 220 may have any one of several different forms, such as to best accommodate the form factor of the treatment device. In the embodiment depicted in FIG. 2, IMFTD retainer 220 is implemented as a sleeve disposed on an exterior surface of brassiere 200 having an upper edge that is located directly below the lowest point of cups 102 and a lower edge that extends to the upper edge of underband 112, or to about 30 mm below the lowest point of cups 102, whichever is higher.

In the illustrative embodiment, IMFTD retainer 220 spans the front of brassiere 200, and includes opening 222 at one or both ends. Opening(s) 222 enables access to the interior of IMFTD retainer 220, such as to place cooling packs, tubes, etc., within IMFTD retainer 220. In this embodiment, several cooling packs 250 are depicted within IMFTD retainer 220.

In the illustrative embodiment, IMFTD retainer 220 is permanently affixed (e.g., thread, fabric glue, fusible bonding tape, etc.) at its upper and lower edges to cradle 104 of brassiere 200. In some other embodiments, IMFTD retainer 220 is configured as a flap; that is, the lower or upper edge of the IMFTD retainer is permanently affixed to cradle 104, whereas the other (long) edge is detachable from cradle 104 (e.g., using hook-and-loop fastener, snaps, etc.).

In yet some further embodiments, IMFTD retainer 220 is removably attached to brassiere 200. In some of such embodiments, IMFTD retainer 220 can be formed into a tube having a strip of hook-and-loop fastener (e.g., VELCRO® brand hook-and-loop fastener, available from Velcro Co. of Manchester, New Hampshire) disposed thereon. A complementary strip of hook-and-loop fastener, to which IMFTD retainer 220 may be removably coupled, is affixed to the bra. (More precisely, one of the strips contains the "hooks" and the other strip contains the "loops".)

As an alternative to using two paired sections of hook-and-loop fastener, one section of hook-and-loop material (the hook section) can be used in conjunction with a "hook-compatible fabric" (i.e., VELCRO®) receptive). A strip of such hook-compatible fabric can be located below cups 102 for receiving a strip of hooks that is disposed on IMFTD retainer 220. Such fabric is commercially available from Darlington Fabrics of Westerly, Rhode Island, and others.

IMFTD retainer 220 may be formed of any suitable material, and may match the fabric used for cradle 104. In some embodiments, IMFTD retainer 220 is formed of, or otherwise incorporates, a portion of a stretchable material (e.g., spandex, etc.), to accommodate packs, tubes, etc., that have a diameter/width that is larger than could be otherwise be accommodated via IMFTD retainer 220 if it were formed of a non-stretch material.

Figure 3:
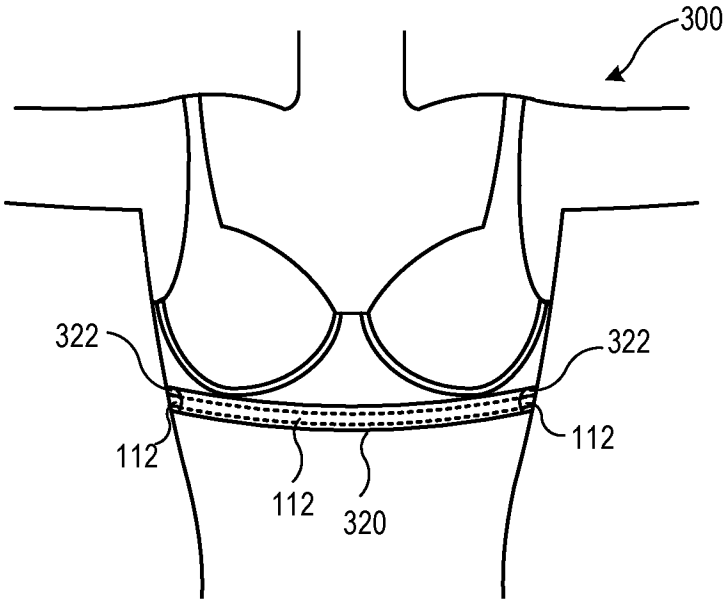
FIG. 3 depicts a brassiere that is physically adapted to provide treatment/pain relief to a wearer at a location that borders, overlies, or partially overlies the IMF in accordance with a second illustrative embodiment of the present invention.

FIG. 3 depicts brassiere 300 in accordance with an illustrative embodiment. Brassiere 300 is substantially similar to brassiere 200, with the exception that IMFTD retainer 320 substantially overlies underband 112. All considerations applying to IMFTD retainer 220 (manner of attachment to the brassiere, materials selection, etc.), as previously described, apply equally to IMFTD retainer 320.

Figure 4:
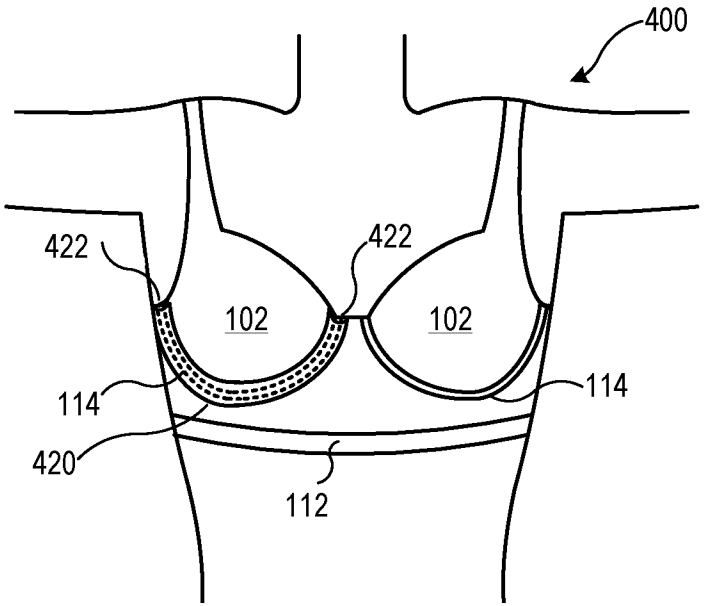
FIG. 4 depicts a brassiere that is physically adapted to provide treatment/pain relief to a wearer at a location that borders, overlies, or partially overlies the IMF in accordance with a third illustrative embodiment of the present invention.

FIG. 4 depicts brassiere 400 in accordance with an illustrative embodiment. Brassiere 400 has the same overall structure as conventional brassiere 100, except for the addition of IMFTD retainer 420, which substantially overlies underwire channel 114. Although depicted as overlying only one cup 102 in FIG. 4, IMFTD retainer 420 typically overlies both cups 102. All considerations applying to IMFTD retainers 220 and 320 (manner of attachment to the brassiere, materials selection, etc.), as previously described, apply equally to IMFTD retainer 420.

It is notable that as IMFTD retainer 420 follows underwire channel 114, portions of the IMFTD retainer may curve upwardly, extending above a wearer's inframammary fold. In some alternative embodiments, IMFTD retainer 420 follows a portion, but not all of underwire channel 114. In such embodiments, the bottom edge of IMFTD retainer 420 should not extend more than 30 mm below the lowest portion of the breast cups.

Figure 5B:
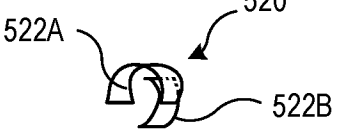
FIG. 5B depicts an alternative embodiment of the retainer used in the brassiere of FIG. 5A.
Figure 5A:
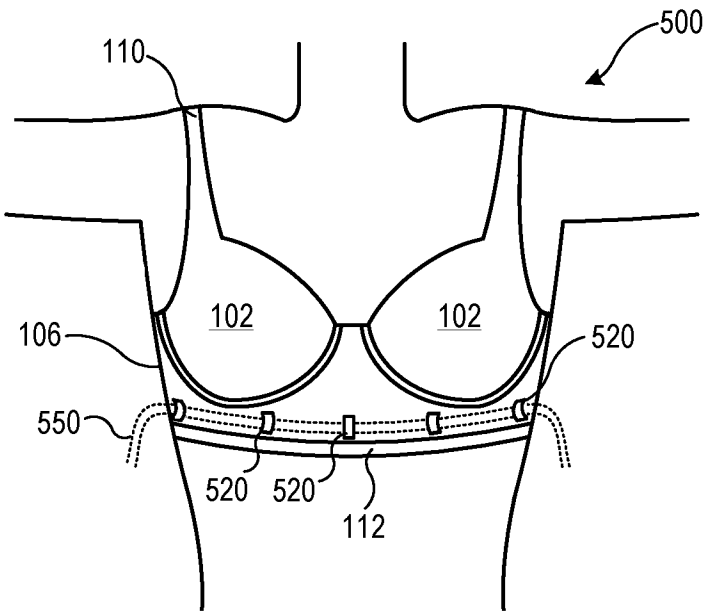
FIG. 5A depicts a brassiere that is physically adapted to provide treatment/pain relief to a wearer at a location that borders, overlies, or partially overlies the IMF in accordance with a fourth illustrative embodiment of the present invention.

FIG. 5A depicts brassiere 500 in accordance with an illustrative embodiment. Brassiere 500 has the same overall structure as conventional brassiere 100, except for the addition of IMFTD retainer 520, which consists of a plurality of loops that extend across the front of brassiere 500 at the same location as IMFTD retainer 220 of FIG. 2. For context, tubing 550 for conveying a cooling fluid is depicted passing through loops of IMFTD retainer 520. All considerations applying to IMFTD retainers 220, 320, and 420 (manner of attachment to the brassiere, materials selection, etc.), as previously described, apply equally to IMFTD retainer 520.

FIG. 5B depicts IMFTD retainer 520', which consists of two strips 522A and 522B of material that couple to one another to form a loop, and which may be substituted for IMFTD retainer 520 of brassiere 500. The free end of each of the strips includes complementary hook-and-loop fastener material so that strips 522A and 522B can be fastened to one another, and provides an embodiment wherein the diameter of IMFTD retainer 520' is adjustable. IMFTD retainer 220 (FIG. 2), IMFTD retainer 320 (FIG. 3), and IMFTD retainer 420 (FIG. 4) may be similarly be implemented in two-part form for use with respective brassieres 200, 300, and 400.

Figure 6:
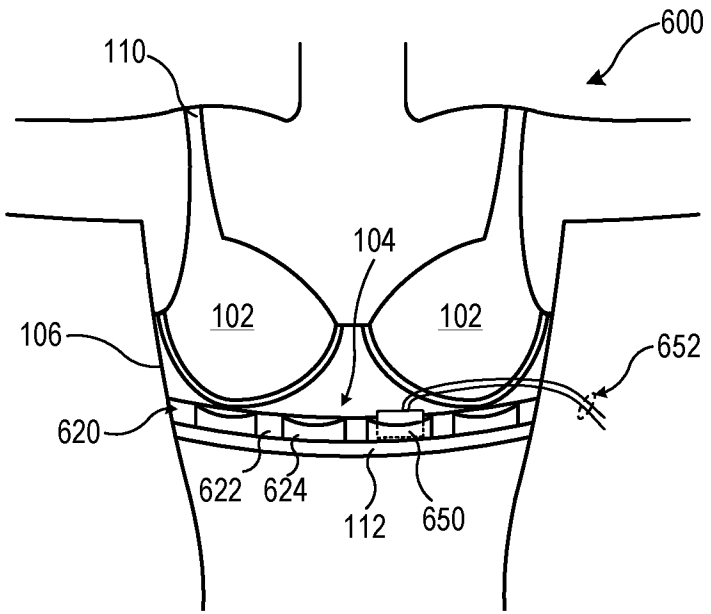
FIG. 6 depicts a brassiere that is physically adapted to provide treatment/pain relief to a wearer at a location that borders, overlies, or partially overlies the IMF in accordance with a fourth illustrative embodiment of the present inventio.
Figure 7:
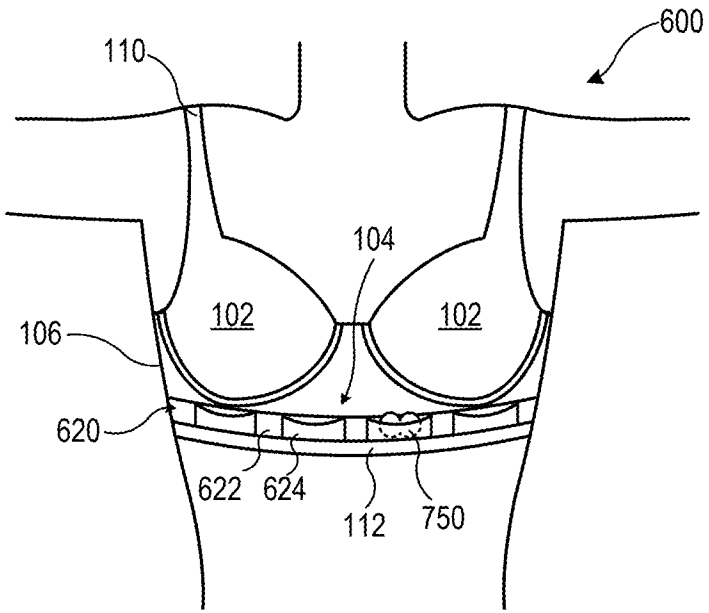
FIG. 7 depicts the brassiere of FIG. 6, wherein a vibratory-pain-relief device is disposed in an inframammary-fold treatment device retainer of the brassiere.

FIG. 6 depicts brassiere 600 in accordance with an illustrative embodiment. Brassiere 600 has the same overall structure as conventional brassiere 100, except for the addition of IMFTD retainer 620. In the illustrative embodiment, IMFTD retainer 620 includes a plurality of pockets 624 that are formed on band 622 of material. In some alternative embodiments, pockets 624 are formed directly on the material that forms cradle 104 of brassiere 600. In some embodiments, pockets 624 comprise a stretch material (e.g., spandex, etc.). For context, thermoelectric device 650 having conductive leads 652 is disposed in one of pockets 624. FIG. 7 depicts brassiere 600 of FIG. 6 in use with vibratory pain relief device 750, rather than thermoelectric device 650 as in FIG. 6.

All considerations applying to IMFTD retainers 220, 320, 420, and 520 (manner of attachment to the brassiere, materials selection, etc.), as previously described, apply equally to IMFTD retainer 620.

As mentioned earlier in this disclosure, brassieres are available in a wide variety of designs and configurations. For example, some bra designs may not include curved (u-shaped) cups, rather having a more linear profile at the bottom of the cup region. It is to be understood that brassieres depicted in the accompanying Figures are provided by way of illustration, not limitation, and the various embodiments of IMFTD retainers disclosed herein may be readily incorporated into such other brassiere designs.

In some embodiments, a brassiere in accordance with the present teachings includes an IMFTD retainer, but does not include breast cups. Such a brassiere may be used, for example, by patients that have had a mastectomy, but no reconstruction.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A treatment brassiere comprising:

two breast cups; and an inframammary-fold treatment-device (IMFTD) retainer selected from the group consisting of a plurality of loops, a sleeve, and at least one pocket, wherein the IMFTD retainer is physically adapted to receive and position an IMFTD device proximate to an inframammary fold of a wearer.

2. The brassiere of claim 1 comprising an underband, wherein the IMFTD retainer is disposed between the bottom of the breast cups and an upper edge of the underband.

3. The brassiere of claim 1 comprising an underband, wherein the IMFTD retainer overlies the underband.

4. The brassiere of claim 1 comprising an underwire channel, wherein the IMFTD retainer overlies at least a portion of the underwire channel.

5. The brassiere of claim 1 wherein the IMFTD retainer is permanently affixed to the brassiere.

6. The brassiere of claim 1 wherein the IMFTD retainer is removably coupled to the brassiere.

7. The brassiere of claim 1 wherein the IMFTD retainer comprises the at least one pocket.

8. The treatment brassiere of claim 1 comprising the inframammary-fold treatment device.

9. A method for treating skin irritations associated with an inframammary fold, the method comprising:

providing a brassiere with an inframammary-fold treatment-device (IMFTD) retainer, wherein a lowest portion of the IMFTD retainer extends to an upper edge of an underband of the brassiere;

disposing an inframammary-fold treatment device in the IMFTD retainer of the brassiere; and when the IMFTD is an active device selected from the group consisting of a cryotherapy device, a thermoelectric cooler, a chilled-liquid circulation system, and a vibratory-pain-relief device, activating the IMFTD, wherein, by virtue of the location of the IMFTD on the brassiere, the IMFTD delivers treatment for the skin irritations.

10. A method for treating skin irritations associated with an inframammary fold, the method comprising:

providing a brassiere with an inframammary-fold treatment-device (IMFTD) retainer, the IMFTD retainer physically adapted to receive and position an inframammary-fold treatment device proximate to an inframammary fold of a wearer; and disposing the inframammary-fold treatment device in the IMFTD retainer, wherein the IMFTD device comprises a cold pack.

11. A treatment brassiere comprising:

two breast cups;

an underband; and an inframammary-fold treatment-device (IMFTD) retainer, wherein the IMFTD retainer is physically configured to receive an inframammary-fold treatment device selected from the group consisting of: a cold pack, a tube for circulating a cooling fluid, a thermoelectric cooler, and a vibratory pain relief device.

12. The treatment brassiere of claim 11 wherein the IMFTD retainer is disposed on an exterior surface of the treatment brassiere.

13. A treatment brassiere comprising:

two breast cups;

an inframammary-fold treatment-device (IMFTD) retainer for receiving an inframammary-fold treatment device; and the inframammary-fold treatment device, wherein the inframammary-fold treatment device is physically adapted to deliver, to the inframammary fold of a wearer of the treatment brassiere, a pain-relief treatment selected from the group consisting of cryotherapy, PEMF therapy, and vibro-analgesia.

* * * * *